US008714501B2

(12) United States Patent
Dang et al.

(10) Patent No.: US 8,714,501 B2
(45) Date of Patent: May 6, 2014

(54) MOUNTING BRACKET FOR A PUMP

(75) Inventors: Thang Q. Dang, Huntington Beach, CA (US); Jim L. Jackson, Jr., Lago Vista, TX (US); Vijay Mallik, Chino Hills, CA (US); John J. Fong, Lake Forest, CA (US)

(73) Assignee: Xylem IP Holdings LLC, White Plains, NY (US)

( * ) Notice: Subject to any disclaimer, the term of this patent is extended or adjusted under 35 U.S.C. 154(b) by 1363 days.

(21) Appl. No.: 11/639,367

(22) Filed: Dec. 14, 2006

(65) Prior Publication Data

US 2008/0142674 A1 Jun. 19, 2008

(51) Int. Cl.

| | |
|---|---|
| ***A47B 96/00*** | (2006.01) |
| ***A47K 1/00*** | (2006.01) |
| ***A47K 5/00*** | (2006.01) |
| ***E04G 5/06*** | (2006.01) |
| ***F16L 3/08*** | (2006.01) |
| ***F21V 21/00*** | (2006.01) |
| ***F21V 35/00*** | (2006.01) |

(52) U.S. Cl.
USPC ..... 248/222.13; 248/316.7; 248/220.22; 248/300

(58) Field of Classification Search
USPC ..... 248/300, 231.81, 222.13, 223.31, 248/316.7, 220.22, 221.12, 220.43, 220.42
See application file for complete search history.

(56) References Cited

U.S. PATENT DOCUMENTS

| | | | | |
|---|---|---|---|---|
| 1,546,576 | A | 7/1925 | Erwin et al. | |
| 2,920,340 | A * | 1/1960 | Hopkins | 16/248 |
| 3,388,885 | A | 6/1968 | Holmes | 248/310 |
| 3,667,437 | A | 6/1972 | Dreisin | |
| 3,684,406 | A | 8/1972 | Edwards | |
| 3,879,068 | A | 4/1975 | Stampfli | |
| 4,042,123 | A | 8/1977 | Sheldon et al. | |
| D253,704 | S | 12/1979 | McGraw | |
| 4,205,537 | A | 6/1980 | Dubberley | |
| 4,247,133 | A | 1/1981 | Moller | |
| 4,256,439 | A | 3/1981 | Kosodo et al. | |
| 4,361,226 | A | 11/1982 | Travis | |
| 4,428,512 | A * | 1/1984 | Nosek | 222/402.15 |
| 4,441,684 | A * | 4/1984 | Credle, Jr. | 248/674 |

(Continued)

FOREIGN PATENT DOCUMENTS

| | | |
|---|---|---|
| EP | 0085588 | 8/1983 |
| EP | 0661236 | 7/1995 |

(Continued)

OTHER PUBLICATIONS

Kawecki, L; Raczynski, S., English language abstract of "Coupling Non-Linear Models in Object Simulation: Application to Drives with Induction Motors." Simulation, vol. 70, o. 2 119-126 (1988) DOI: 10.1177/003754979807000204.

(Continued)

*Primary Examiner* — Nkeisha Smith

(57) ABSTRACT

A mounting bracket may include a base plate, at least one stationary clip disposed on the base plate, a push releasing plate disposed in spaced apart relation to the at least one stationary clip, and at least one movable clip operatively coupled to and movable with the push releasing plate. The stationary clip or clips and movable clip or clips are disposed and configured to mate with cavities in respective ends of a pump when the push releasing plate is in a non-pivoted position.

10 Claims, 4 Drawing Sheets

(56) References Cited

U.S. PATENT DOCUMENTS

| | | | | |
|---|---|---|---|---|
| 4,444,320 | A | 4/1984 | Chap | |
| 4,478,337 | A | 10/1984 | Flum | |
| 4,483,365 | A | 11/1984 | Fallon | |
| 4,512,305 | A | 4/1985 | Pitozzi | |
| 4,513,796 | A | 4/1985 | Miller et al. | |
| 4,555,978 | A | 12/1985 | Burandt et al. | |
| 4,559,036 | A | 12/1985 | Wunsch | |
| 4,566,352 | A | 1/1986 | Stiff | |
| 4,582,223 | A | 4/1986 | Kobe | |
| 4,643,335 | A | 2/1987 | Carnisio | |
| 4,655,352 | A | 4/1987 | Noyes et al. | |
| 4,673,390 | A | 6/1987 | Archibald | |
| 4,720,768 | A | 1/1988 | Schindele | |
| 4,735,310 | A | 4/1988 | Lemery et al. | |
| 4,741,074 | A | 5/1988 | Budano, II et al. | |
| 4,747,495 | A | 5/1988 | Hoss | |
| 4,795,122 | A | 1/1989 | Petre | |
| 4,815,496 | A | 3/1989 | Nishitani et al. | |
| 4,905,944 | A | 3/1990 | Jost et al. | |
| 4,915,238 | A | 4/1990 | Cassel | |
| 5,011,011 | A | 4/1991 | Kidd | |
| 5,108,271 | A | 4/1992 | Berges et al. | |
| 5,154,586 | A | 10/1992 | Rudick | |
| 5,199,567 | A | 4/1993 | Discko, Jr. | |
| 5,207,642 | A | 5/1993 | Orkin et al. | |
| 5,215,726 | A | 6/1993 | Kudla et al. | |
| 5,259,731 | A | 11/1993 | Dhindsa et al. | |
| 5,305,923 | A | 4/1994 | Kirschner et al. | |
| 5,314,092 | A | 5/1994 | Jacobsen et al. | |
| 5,332,123 | A | 7/1994 | Farber et al. | |
| 5,381,243 | A * | 1/1995 | Imamura | 358/471 |
| D357,923 | S | 5/1995 | Peterson et al. | |
| 5,450,971 | A | 9/1995 | Boron et al. | |
| 5,472,317 | A | 12/1995 | Field et al. | |
| 5,480,288 | A | 1/1996 | Hellenberg et al. | |
| 5,492,455 | A | 2/1996 | Durham et al. | |
| 5,494,250 | A * | 2/1996 | Chen | 248/316.7 |
| 5,495,392 | A | 2/1996 | Shen | |
| 5,520,118 | A | 5/1996 | McCarthy | |
| 5,524,983 | A | 6/1996 | Dittgen et al. | |
| 5,527,289 | A | 6/1996 | Foster et al. | |
| 5,553,934 | A | 9/1996 | Wells et al. | |
| 5,607,083 | A | 3/1997 | Vogel et al. | |
| 5,624,044 | A | 4/1997 | Black, Jr. | |
| 5,624,167 | A * | 4/1997 | Katz | 312/223.1 |
| 5,626,467 | A | 5/1997 | Cantley | |
| D380,479 | S | 7/1997 | Cantley et al. | |
| 5,645,182 | A | 7/1997 | Miller, Jr. et al. | |
| 5,645,540 | A | 7/1997 | Henniges et al. | |
| 5,647,491 | A | 7/1997 | Foster et al. | |
| 5,660,286 | A | 8/1997 | Shea | |
| 5,664,292 | A | 9/1997 | Chen | |
| 5,666,271 | A | 9/1997 | Kim et al. | |
| 5,683,012 | A | 11/1997 | Villaveces | |
| D388,439 | S | 12/1997 | Cantley et al. | |
| 5,795,005 | A | 8/1998 | Garfias et al. | |
| 5,797,519 | A | 8/1998 | Schroeder et al. | |
| 5,944,298 | A | 8/1999 | Koike | |
| 5,996,184 | A | 12/1999 | Mah et al. | |
| 6,050,662 | A | 4/2000 | Filipek et al. | |
| 6,056,256 | A | 5/2000 | Ponce | |
| 6,059,130 | A | 5/2000 | Grainger | |
| 6,123,208 | A | 9/2000 | Haenszel | |
| 6,142,321 | A | 11/2000 | West | |
| 6,161,708 | A | 12/2000 | Myler | |
| 6,213,739 | B1 | 4/2001 | Phallen et al. | |
| 6,237,810 | B1 | 5/2001 | Credle, Jr. | |
| 6,241,106 | B1 | 6/2001 | Fujita et al. | |
| 6,267,268 | B1 | 7/2001 | Quartarone et al. | |
| D446,968 | S | 8/2001 | Spencer | |
| 6,279,761 | B1 | 8/2001 | Niewiadomski et al. | |
| 6,302,036 | B1 | 10/2001 | Carson et al. | |
| 6,305,767 | B1 | 10/2001 | Filipek et al. | 312/352 |
| 6,318,687 | B2 | 11/2001 | Trana et al. | |
| 6,332,548 | B1 | 12/2001 | West et al. | |
| 6,349,837 | B1 | 2/2002 | Serban | |
| 6,435,357 | B1 | 8/2002 | Lee | |
| 6,708,830 | B2 | 3/2004 | Mendoza | |
| 6,729,598 | B2 | 5/2004 | Folliot et al. | 248/671 |
| 6,834,768 | B2 * | 12/2004 | Jersey et al. | 211/189 |
| 6,841,293 | B1 | 1/2005 | Dreulle et al. | |
| 6,874,756 | B2 * | 4/2005 | Hawkins et al. | 251/291 |
| 7,017,875 | B2 * | 3/2006 | Chen et al. | 248/300 |
| 7,100,882 | B2 | 9/2006 | Behroozi | |
| 7,225,936 | B2 * | 6/2007 | Jersey et al. | 211/189 |
| 7,350,537 | B2 * | 4/2008 | Honermann | 137/343 |
| 2002/0117462 | A1 | 8/2002 | Hung | |
| 2005/0196303 | A1 | 9/2005 | Kenney | 417/413.1 |
| 2008/0116344 | A1 * | 5/2008 | Whitt | 248/316.1 |

FOREIGN PATENT DOCUMENTS

| | | |
|---|---|---|
| EP | 0805544 | 11/1997 |
| EP | 1059188 | 12/2000 |
| EP | 1210298 | 5/2002 |
| KR | 20030037124 | 5/2003 |
| WO | 8707236 | 12/1987 |
| WO | 9606798 | 3/1996 |

OTHER PUBLICATIONS

Matsumoto, Y., et al., English language abstract of "A Novel Parallel-Connected Multiple Induction Motors Vector Control Method for the Rolling Stock Traction System," Transactions of the Institute of Electrical Engineers of Japan (2001), vol. 121, No. 7, pp. 747-755. http://sciencelinks.jp/j-east/article/200121/000020012101A0744278.php.

Tatematsu, M., et al., English language abstract of "Stabilization of Multi-machine Power Systems by Coordinated Excitation Control of Multiple Adjustable-speed Generator/Motors," Electrical Engineering in Japan (English translation of Denki Gakkai Ronbunshi). vol. 118, No. 4, pp. 10-19. 1997. http://md1.csa.com/partners/viewrecord.php?requestor=gs&collection=TRD&recid=0280925EN &recid=028025EA&q=&uid=792344017&setcookie=yes.

English language abstract of EP1059188.

English language abstract of EP0805544.

English language abstract of KR20030037124.

Kawecki, L.; Raczynski, S., "Simulating mechanisms driven by multiple induction motors," Conference: Proceedings of the 1997 Summer Computer Simulation Conference Simulation and Modeling Technology for the Twenty-First Century, p. 610-15. Editor: Obaidat, M.S. Publisher: SCSI, San Diego, CA, USA, 1997, xvii+957 Pages.

Matsumoto, Y., et al., "A Novel Parallel-Connected Multiple Induction Motors Vector Control Method for the Rolling Stock Traction System," Transactions of the Institute of Electrical Engineers of Japan (2001), vol. 121, No. 7, pp. 747-755. http://sciencelinks.jp/j-east/article/200121/000020012101A0744278.php.

Tatematsu, M., et al., "Stabilization of Multi-machine Power Systems by Coordinated Excitation Control of Multiple Adjustable-speed Generator/Motors," Electrical Engineering in Japan (English translation of Denki Gakkai Ronbunshi). vol. 118, No. 4, pp. 10-19. 1997. http://md1.csa.com/partners/viewrecord.php?requestor=gs&collection=TRD&recid=0280925EN &recid=028025EA&q=&uid=792344017&setcookie=yes.

EP0661236—6 pages English Language Translation.

EP0085588—5 pages English Language Translation.

* cited by examiner

MOUNTING BRACKET FOR A PUMP

BACKGROUND OF THE INVENTION

1. Technical Field

The present invention pertains to the field of mounting brackets. More particularly, the present invention pertains to mounting brackets configured to receive and retain pumps, such as air pumps.

2. Discussion of Related Art

Mounting brackets are generally used to secure devices, for example pumps, to a particular location so that the pump remains stationary while in use by a user. For example, a mounting bracket may be screwed onto a surface, such as a wall, and the pump mounted on the bracket will have a fixed location. Therefore, the user must move to the fixed location of the pump in order to use the pump. Having the pump secured at a fixed location may create problems if the user is limited in the location that the user can use the pump. In order to overcome the problems associated with existing mounting brackets what is needed is a mounting bracket that is easily movable to a different location from its present location, while still allowing for the pump that is attached to the bracket to be secured. For example, a mounting bracket that is movable without having to separate the mounting bracket from the surface the mounting bracket is secured to. In addition, it may be advantageous to also provide the mounting bracket so that the pump itself is easily removable from the bracket.

SUMMARY OF THE INVENTION

In accordance with an embodiment of the present invention a mounting bracket is provided that may be coupled to a pump, such as a Flojet air pump (N5000), to allow secure mounting of the pump to a slide track so that the pump is movable while attached to the mounting bracket, and also to allow quick disconnecting of the mounting bracket from the pump.

In accordance with an embodiment of the present invention, the mounting bracket may include a base plate, at least one stationary clip disposed on the base plate in a substantially fixed location and orientation, a push-releasing plate disposed in spaced apart relation to the at least one stationary clip, and at least one movable clip operatively coupled to and movable with the push-releasing plate. The at least one stationary clip and at least one movable clip may be disposed and configured to mate with cavities in respective end caps of a pump when the push-releasing plate is in a non-pivoted position. The push-releasing plate may be resiliently and pivotably coupled to the base plate.

The base plate in an embodiment of the present invention may have a ribbed structure configured and arranged to serve as a strength member. The base plate may also include opposing sides configured so as to slidably couple the base plate to a tracked bracket holder. The base plate may also include at least one fastener receiving device.

In an embodiment of the present invention the at least one movable clip may be positioned on the push-releasing plate in a substantially fixed location and orientation.

The mounting bracket in an embodiment of the invention may also include a valve coupling configured to hold a valve of the pump. The mounting bracket may also include at least one spring configured to provide resistance against a tracked bracket holder.

The mounting bracket in an embodiment of the invention may include at least two stationary clips. The mounting bracket may include at least two movable clips.

BRIEF DESCRIPTION OF THE DRAWINGS

The above and other objects, features and advantages of the invention will become apparent from a consideration of the subsequent detailed description presented in connection with accompanying drawings, in which.

DETAILED DESCRIPTION

Figure 1:
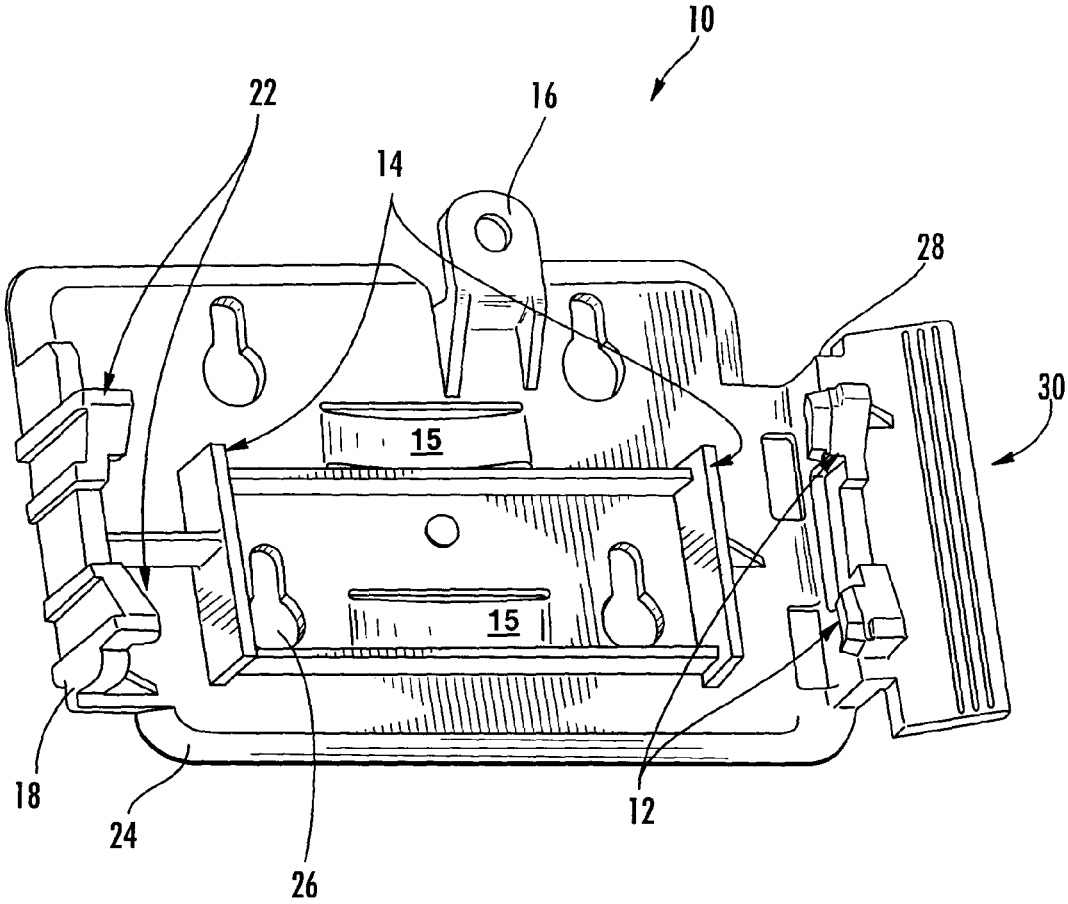
FIG. 1 is a front perspective view of a bracket according to an aspect of the invention.

The mounting bracket 10, as seen in FIG. 1, includes a base plate 24 with a stationary side 18. The stationary side 18 may include one or more stationary hooks 22 that may be coupled to the stationary side 18 so that the one or more stationary hooks 22 do not move relative to the base plate 24 when a force is applied to the one or more hooks 22. As shown, the mounting bracket 10 includes two stationary hooks 22, but it is understood that the invention may be implemented with one stationary hook or multiple stationary hooks. The stationary side 18 may be held in place relative to the base plate 24 by supporting structures or because the stationary side 18 is made from non-flexible material.

The mounting bracket 10 may also include a flexible side 28 that may include one or more flexible hooks 12. The flexible side 28 may also include a push-releasing plate 30. The push-releasing plate 30 is operatively coupled to the one or more flexible hooks 12 so the flexible hooks 12 move in the direction that the push-releasing plate 30 is urged, by for example an external force. The flexible side 28 and flexible hooks 12 may be made from substantially the same material as the mounting bracket 10, or may be formed from a material that is more flexible than the other components of the mounting bracket.

The mounting bracket 10 as shown includes one or more ribs 14 that form a rib structure to provide strength to the mounting bracket. For example, the mounting bracket 10 may be formed from a flexible material so that it is of one piece construction, and the flexible side 28 is capable of deflecting upon the application of force. The ribs 14 may be positioned on the side of the base plate 24 to which the stationary hooks 22 and flexible hooks 12 are coupled. As seen in FIG. 1, for example, the ribs 14 themselves may also be supported by additional structures.

The mounting bracket 10 includes one or more mounting holes 26 that are configured to receive a fastening device, such as a screw, nail, fastener or the like, in order to mount the mounting bracket 10 in a particular location. The mounting holes 26 may be configured so that the mounting bracket 10 may be slidably fastened to the fastening device or devices. For example, as seen in FIG. 1, the mounting holes 26 may be larger towards the bottom than they are at the top. In this manner, the mounting bracket 10 may be placed in a position so that the fastening device or devices protrude through the base plate 24, and then by downwardly urging the mounting bracket 10 the mounting will be fastened to the fastening device or devices.

The mounting bracket 10 may also include a valve coupling 16 for securing or mounting a valve (not shown) that may be attached to a pump coupled to the mounting bracket 10. For example, the valve coupling 16 may be used to mount a transfer valve to the top of the pump coupled to the mounting bracket.

Figure 2:
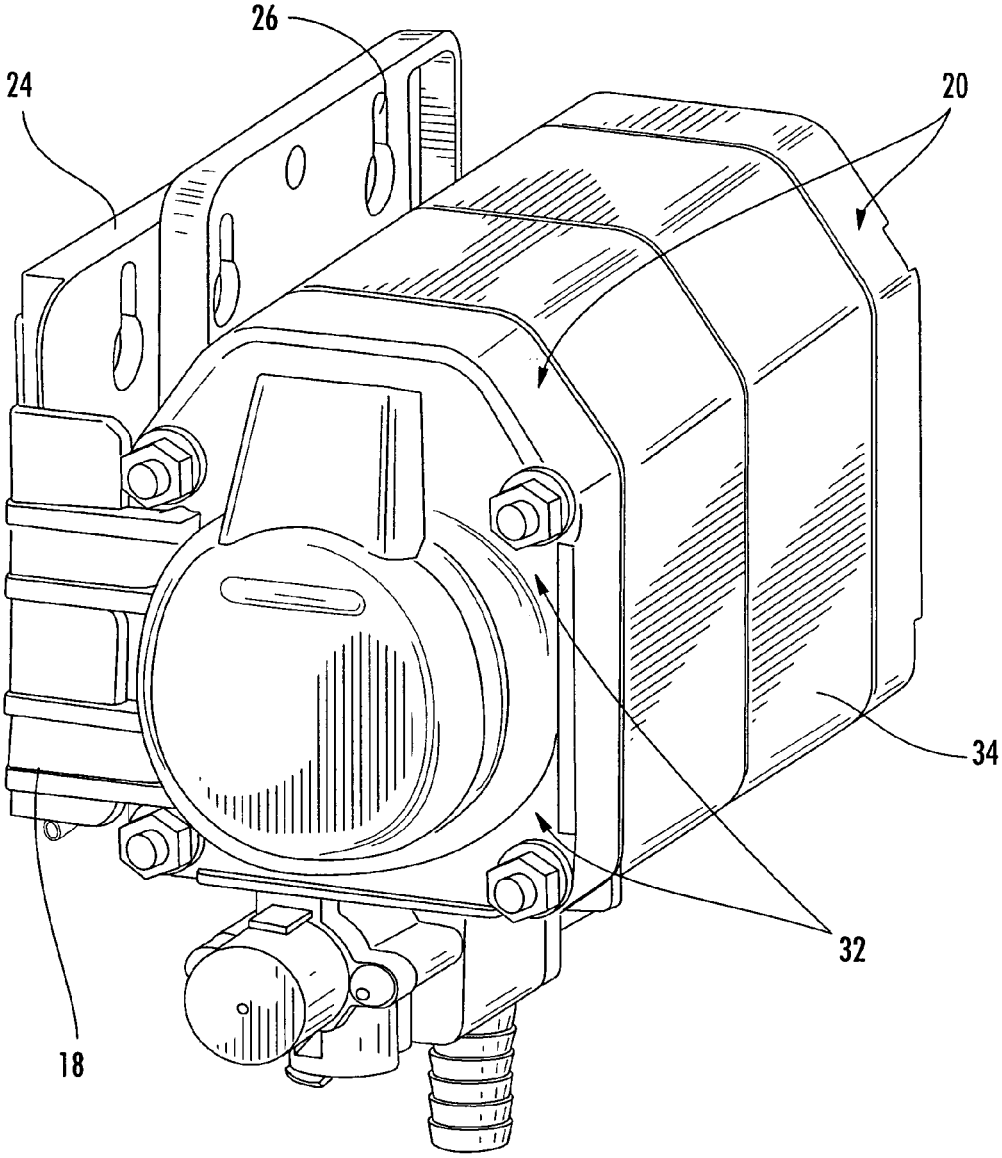
FIG. 2 is a stationary side view of the bracket of FIG. 1 coupled to a pump.
Figure 3:
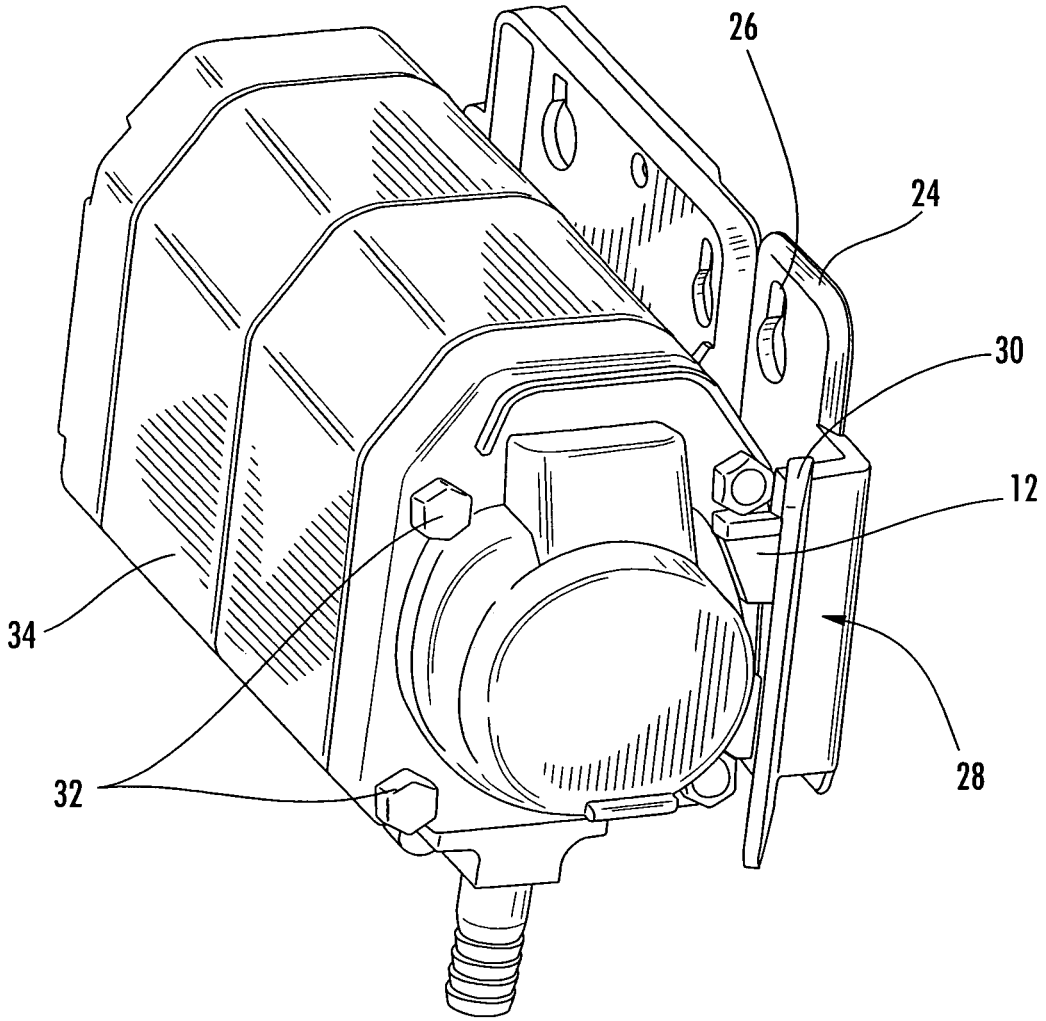
FIG. 3 is a view of the flexible side of the bracket of FIG. 1 coupled to a pump.

As shown in FIG. 2, the mounting bracket 10 may be configured to receive and support a pump 34, for example an air pump. The pump 34 may be a Flojet N5000 Air Pump, for example. However, it is contemplated that the mounting bracket 10 may be configured to receive and support a variety of pumps known to one skilled in the art. The stationary hooks 22 are configured to engage hollow cavities 32 in the end caps 20 of the pump 34. FIG. 2 shows one exemplary embodiment of a configuration of stationary hooks 22 that may be used to engage the hollow cavities 32 in order to receive and support the pump 34. FIG. 3 shows a perspective of the pump 34 supported by the mounting bracket 10 from the flexible side 28. As seen in FIGS. 2 and 3 the stationary hooks 22 engage hollow cavities 32 on one side of the pump 34, while the flexible hooks 12 engage the hollow cavities 32 on the other side of the pump 34. For example, the Flojet N5000 Air Pump has hollow cavities on the end caps of the pump, and the stationary hooks 22 and flexible hooks may be configured to engage these hollow cavities on respective end caps of the Flojet N5000 Air Pump.

The mounting bracket 10 is configured to support and retain the pump 34 by positioning the hollow cavities 32 on one end of the pump against the stationary hooks 22. The other end of the pump 34 may then be urged towards the base plate 24, and the flexible hooks 12 can be deflected away from the pump 34 by the pressure of the end cap 20 of the pump on the flexible hooks 12, or due to a force applied to the push-releasing plate 30. When the pump 34 is positioned against the base plate 24, or possibly the ribs 14, the flexible hooks 12 will couple with the hollow cavities 32 of the pump 34 and secure the pump 34 into the mounting bracket 10. To release the pump 34 from the mounting bracket 10, a force may be applied to the push-releasing plate 30, such as by pushing on the plate 30 to disengage the flexible hooks 12 from the hollow cavities of the pump 34.

Figure 4:
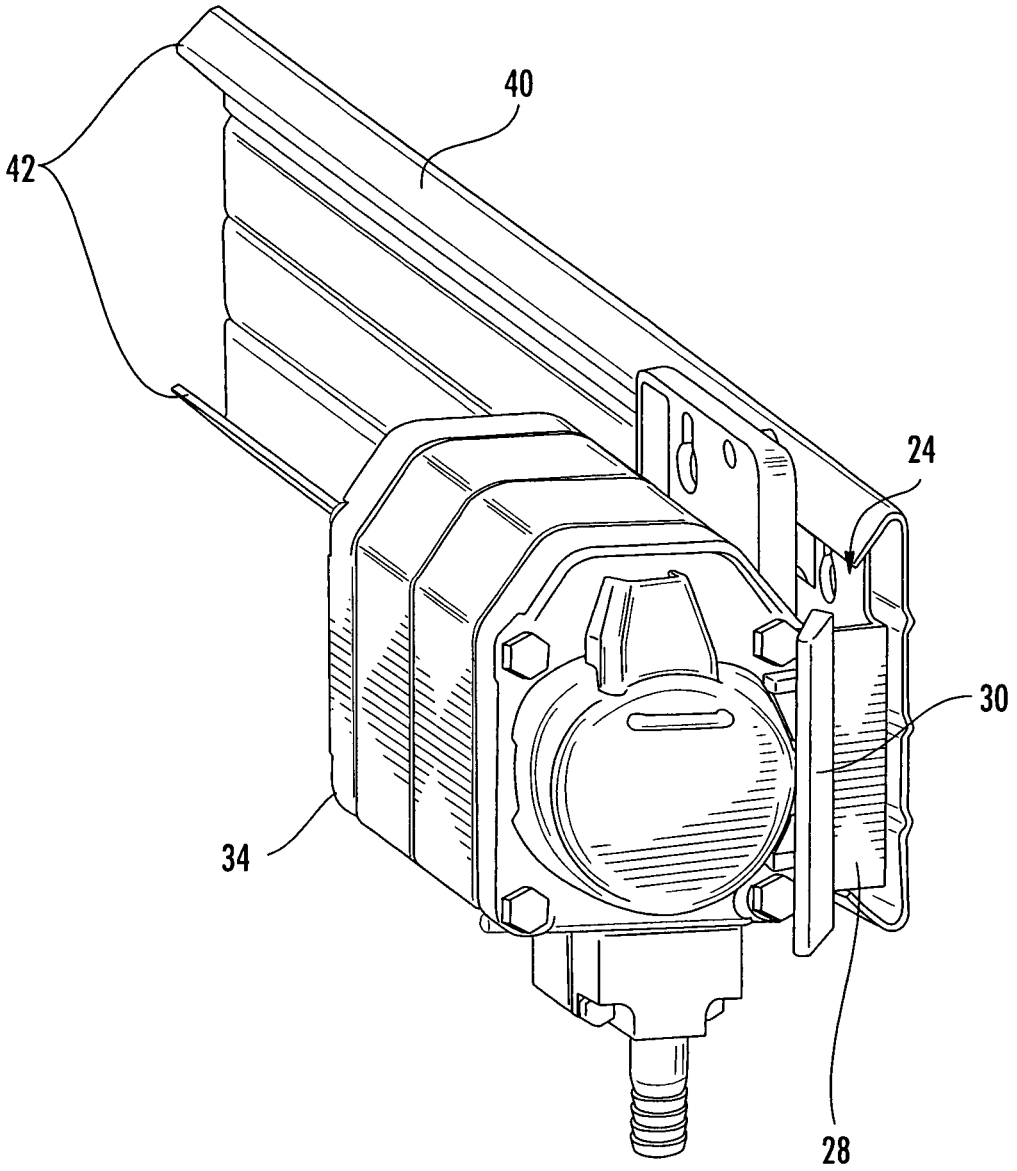
FIG. 4 is a view of the flexible side of the bracket of FIG. 1 coupled to a pump and slidably mounted to a slide track.

As seen in FIG. 4, the mounting bracket 10 may also be configured to slide into a slide track 40. The slide track 40 may include folded edges 42 that are configured to couple to the base plate 24 of the mounting bracket 10. As seen in FIG. 1, the edges of the base plate 24 may be tapered to facilitate insertion of the mounting bracket 10 into the slide track. In this manner, the mounting bracket 10 may allow for the pump 34, such as a Flojet Air Pump N5000, to be securely mounted on the slide track 40, and easily removed for pump maintenance or replacement.

As further seen in FIG. 1, the mounting bracket 10 may also include one or more springs 15, for example leaf springs, that are configured to provide resistance against the slide track 40 so that the mounting bracket 40 remains relatively stationary unless a user applies sufficient force to overcome the resistance supplied by the springs 15 against the slide track 40.

It is to be understood that the above-described arrangements are only illustrative of the application of the principles of the present invention. Numerous modifications and alternative arrangements may be devised by those skilled in the art without departing from the scope of the present invention, and the appended claims are intended to cover such modifications and arrangements.

What is claimed is:

1. A mounting bracket (10) configured to receive, support and mount a pump (34) having end caps (20) on each side with hollow cavities (32), the bracket comprising:

a base plate (24) having a stationary side (18) on one end and a flexible side (28) on another end;

the stationary side (18) having one or more stationary hooks (22) coupled thereto that substantially do not move relative to the base plate (24) when a force is applied to the one or more stationary hooks (22), the stationary hooks (22) being configured to frictionally engage the hollow cavities (32) in the end caps (20) on one side of the pump (34) to receive, support and mount the pump (34); and the flexible side (28) having one or more flexible hooks (12), the flexible side (28) including a push-releasing plate (30) that is operatively coupled to the one or more flexible hooks (12) so the flexible hooks (12) move in a direction that the push-releasing plate (30) is urged, including by an external force applied by a user, the flexible hooks (12) being configured to frictionally engage the hollow cavities (32) on the other side of the pump (34) to receive, support and mount the pump (34).

2. The mounting bracket (10) according to claim 1, wherein the mounting bracket (10) is configured to receive, support and retain the pump (34) by positioning the hollow cavities (32) on one end of the pump (34) against the one or more stationary hooks (22), urging the other end of the pump (34) towards the base plate (24), deflecting the one or more flexible hooks (12) away from the pump (34) either by a pressure of the end cap (20) of the pump (34) on the one or more flexible hooks (12), or due to the external force applied by the user to the push-releasing plate (30), and positioning the pump (34) against either the base plate (24) or ribs (14), so that the flexible hooks (12) couple with the hollow cavities (32) of the pump (34) and secure the pump (34) into the mounting bracket (10).

3. The mounting bracket (10) according to claim 1, wherein the mounting bracket (10) is configured to release the pump (34) by applying a force to the push-releasing plate (30), including by pushing on the push-releasing plate (30) to disengage the flexible hooks (12) from corresponding hollow cavities (32) of the pump (34).

4. The mounting bracket (10) according to claim 1, wherein the one or more stationary hooks (22) includes two stationary hooks (22).

5. The mounting bracket (10) according to claim 1, wherein the one or more flexible hooks (12) includes two flexible hooks (12).

6. The mounting bracket (10) according to claim 1, wherein the flexible side (28) and the one or more flexible hooks (12) is either made from substantially a same material as the mounting bracket (10), or formed from a material that is more flexible than other components of the mounting bracket (10).

7. The mounting bracket (10) according to claim 1, wherein the mounting bracket (10) includes one or more strengthening ribs (14) that form a rib structure to provide strength to the mounting bracket (10).

8. The mounting bracket (10) according to claim 1, wherein the mounting bracket (10) is formed from a flexible material so that it is of one piece construction, and the flexible side (28) is capable of deflecting upon application of an applied force.

9. The mounting bracket (10) according to claim 1, wherein the mounting bracket (10) is configured to slide into a slide track (40) that includes folded edges (42) configured to couple to the base plate (24) of the mounting bracket (10).

10. The mounting bracket (10) according to claim 9, wherein the mounting bracket (10) includes one or more springs (15), including leaf springs, that are configured to provide resistance against the slide track (40) so that the mounting bracket (10) remains relatively stationary unless a user applies sufficient force to overcome the resistance supplied by the springs (15) against the slide track (40).

* * * * *